US010960318B2

(12) United States Patent
Sy

(10) Patent No.: US 10,960,318 B2
(45) Date of Patent: Mar. 30, 2021

(54) FLOATABLE TOYS

(71) Applicant: Yat Lun Sy, HongKong (CN)

(72) Inventor: Yat Lun Sy, HongKong (CN)

( * ) Notice: Subject to any disclaimer, the term of this patent is extended or adjusted under 35 U.S.C. 154(b) by 0 days.

(21) Appl. No.: 16/661,662

(22) Filed: Oct. 23, 2019

(65) Prior Publication Data

US 2020/0269151 A1 Aug. 27, 2020

(30) Foreign Application Priority Data

Feb. 26, 2019 (CN) ..... 201920243610.2

(51) Int. Cl.
*A63H 23/00* (2006.01)

(52) U.S. Cl.
CPC ..... *A63H 23/005* (2013.01)

(58) Field of Classification Search
CPC ..... A63H 23/005; A63H 23/10
USPC ..... 446/153, 156, 157, 158, 159, 370, 373
See application file for complete search history.

(56) References Cited

U.S. PATENT DOCUMENTS 2,651,873 A * 9/1953 Risch ..... A01M 31/06 43/3
2,719,376 A * 10/1955 Risch ..... A01M 31/06 43/3
2,932,916 A * 4/1960 Strickland ..... A63H 23/08 446/156
3,074,195 A * 1/1963 Vanderpool ..... A01M 31/06 43/3
4,964,836 A * 10/1990 Kamei ..... A63H 3/04 446/370
5,480,341 A * 1/1996 Plakos ..... A63H 3/16 434/274
6,560,912 B1 * 5/2003 Achepohl ..... A01M 31/06 43/3
7,788,839 B2 * 9/2010 McPherson ..... A01M 31/06 43/2
9,084,716 B1 * 7/2015 Bawden ..... A01M 31/06
9,999,216 B1 * 6/2018 Bawden ..... A01M 31/06
10,478,738 B1 * 11/2019 Wong ..... A63H 23/10
2006/0123688 A1 * 6/2006 Box ..... A01M 31/06 43/3
2011/0014845 A1 * 1/2011 Monahan ..... A63H 23/10 446/153

* cited by examiner

*Primary Examiner* — Joseph B Baldori

(57) ABSTRACT

A floatable toy, including a toy body and a skeleton. The toy body is provided with a receiving cavity and a first opening. The skeleton passes through the first opening and is located in the receiving cavity. The skeleton is provided with a first engaging portion on which a clamping groove is provided. The clamping groove is adapted to the first opening, and the toy body engages with the clamping groove in a snap fit through the first opening to fixedly connect the toy body and the skeleton, thereby sealing the receiving cavity. In this way, the toy body and the skeleton are connected and fixed in a detachable manner, the receiving cavity is opened or closed by the skeleton. Therefore, the interior of the floatable toy can be cleaned.

10 Claims, 8 Drawing Sheets

FLOATABLE TOYS

TECHNICAL FIELD

The present application relates to toys, and more particularly to floatable toys.

BACKGROUND OF THE INVENTION

Tradition floatable toys are popular for children and adults which give a company during bath time. In general, the existing floatable toys are consisting of hollow plastic body which seals air inside to create floating ability without water entering into the interior of the toy.

However, in some floatable toys, a small opening for whistle is built on the body for squeaking sound which therefore water and moisture can enter the interior of the shell but cannot be empty out completely. After a period of time, this wet and humid environment at the interior of the shell allows bacteria to grow but cannot be cleaned easily because it is mostly enclosed.

SUMMARY OF THE INVENTION

The present application aims to provide a floatable toy, with an interior which can be cleaned by dismantling engaging portions.

In order to solve the above problem, the present invention provides a floatable toy, comprising:

a toy body provided with a receiving cavity and a first opening, and a skeleton provided with a first engaging portion;

wherein the first opening communicates with the receiving cavity and an external environment; and a clamping groove is provided on the first engaging portion; the clamping groove and the first opening are assembled to connect and fix the toy body and the skeleton in a snap fit, thereby sealing the receiving cavity.

In some embodiments, the first engaging portion comprises an outer engaging portion and an inner engaging portion.

The outer engaging portion and the inner engaging portion are both circular, and the inner engaging portion extends from a side of the outer engaging portion, and the clamping groove extends around the inner engaging portion.

In some embodiments, the clamping groove and the first opening are assembled, and the outer engaging portion is located outside the receiving cavity.

In some embodiments, the skeleton further comprises a reinforcing portion; the reinforcing portion in a semi-circular shape is connected to the inner engaging portion and is located in the receiving cavity; and the outer engaging portion, the inner engaging portion and the reinforcing portion have the same center.

In some embodiments, the skeleton further comprises a hanger ring located in the receiving cavity; the hanger ring is connected to the reinforcing portion and the inner engaging portion and is bent at a junction of the hanger ring and the reinforcing portion and that of the hanger ring and the inner engaging portion, and a through hole is provided on the hanger ring.

In some embodiments, the skeleton further comprises a first connecting portion located in the receiving cavity; and the first connecting portion is S-shaped, and one end of the first connecting portion is connected to the inner engaging portion, and the first connecting portion and the hanger ring are respectively located on opposite sides of the inner engaging portion.

In some embodiments, the skeleton further comprises a second connecting portion located in the receiving cavity; and the second connecting portion is connected to the other end of the first connecting portion, and the second connecting portion is bent at a junction of the first connecting portion and the second connecting portion.

In some embodiments, the second connecting portion is provided with a mounting hole which is a through hole; the toy further comprises a second engaging portion; a second opening is arranged on the toy body at a position corresponding to the second engaging portion; and one end of the second engaging portion passes through the second opening and tightly fits with the mounting hole.

In some embodiments, a blocking portion composed of two parts is provided on the second connecting portion along a radial direction of the second connecting portion; the two pans are respectively located outside the second connecting portion, and are symmetrically connected with respect to the first connecting portion.

In some embodiments, the toy body and the skeleton are both made of plastics; further, the toy body is made of soft plastics which are stretchable.

The invention has the following beneficial effects. The toy body is provided with the receiving cavity and the first opening which is configured to communicate with the receiving cavity and the external environment. The skeleton is provided with the engaging portion on which the clamping groove is provided. When the first opening and the clamping groove are closely engaged, the skeleton is partially accommodated in the receiving cavity to ensure that the floatable toy is sealed. Moreover, the interior of the floatable toy can be cleaned by dismantling the skeleton.

Figure 1:
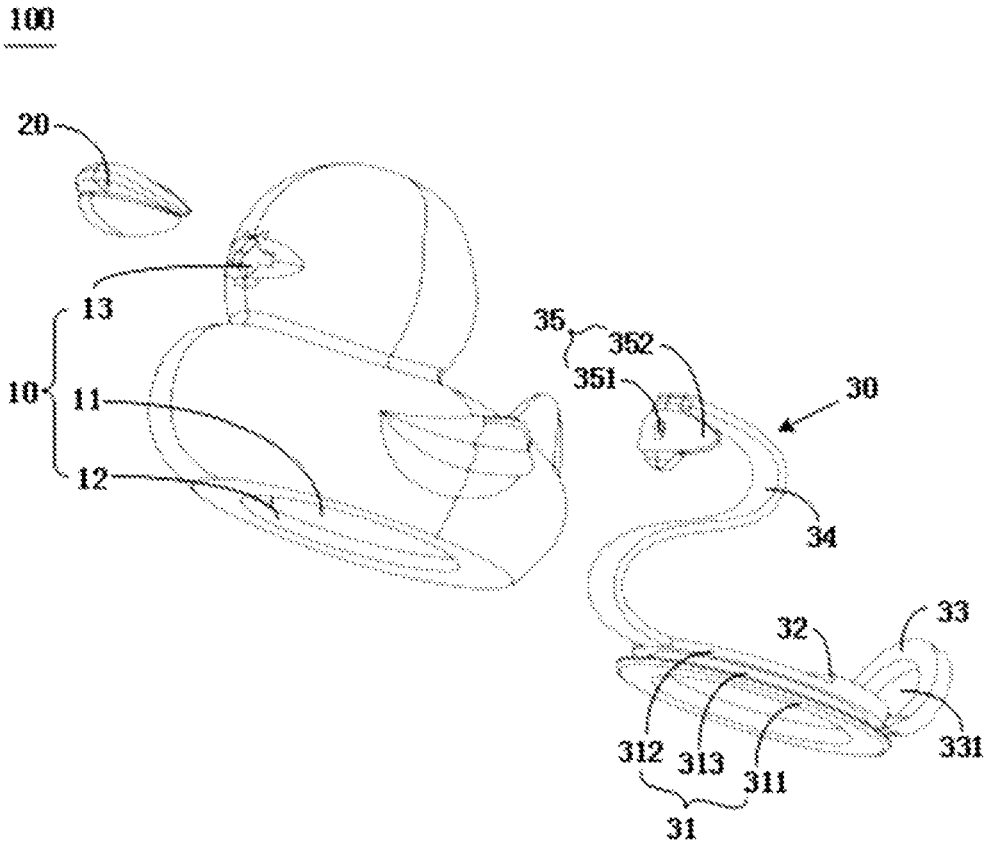
FIG. 1 is an exploded view of a floatable toy according to a first embodiment of the present invention.

In the drawings: 100, floatable toy; 10, toy body; 20, second engaging portion; 30, skeleton; 11, receiving cavity; 12, first opening; 13, second opening; 21, mushroom head rivet; 31, first engaging portion; 32, reinforcing portion; 33, hanger ring; 34, first connecting portion; 35, second connecting portion; 311, outer engaging portion; 312, inner engaging portion; 313, clamping groove; 331, through hole; 332, first hanger ring; 333, second hanger ring; 334, through groove; 341, first bending portion; 342, second bending portion; 343, first cavity; 344, second cavity; 351, mounting hole; and 352, blocking portion.

DETAILED DESCRIPTION OF EMBODIMENTS

The present invention will be further described in detail below with reference to the accompanying drawings and embodiments, from which the present invention will be better understood. It should be noted that when an element is "fixed to" another element, the element can be connected to that element, or through one or more other elements arranged therebetween. An element being "connected to" another element means that the element can be directly connected to that element, or through one or more other elements arranged therebetween. Terms "vertical", "horizontal", "left", "right", "interior" and "exterior", etc. used in the description are for illustrative purpose.

Unless defined otherwise, all technical terms used in the specification have the same meanings as commonly understood by those skilled in the art. The terms used in the description are intended to illustrate the embodiments but not to limit the scope of the present invention. The term "and/or" used herein comprises any one of and all combinations of one or more associated listed items.

Example 1

Figure 2:
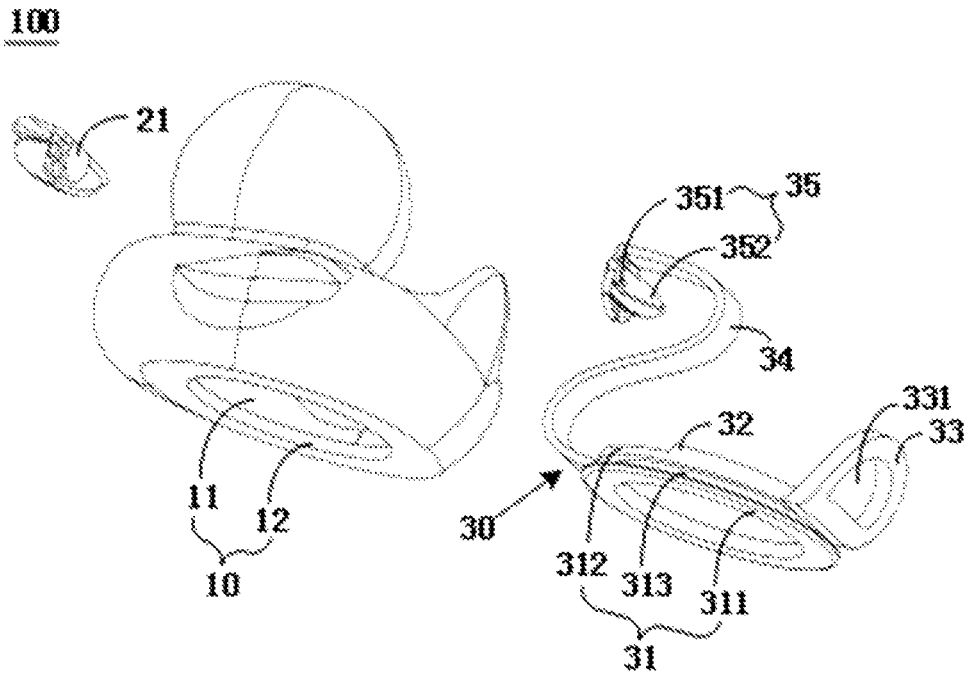
FIG. 2 is another exploded view of the floatable toy shown in FIG. 1.
Figure 3:
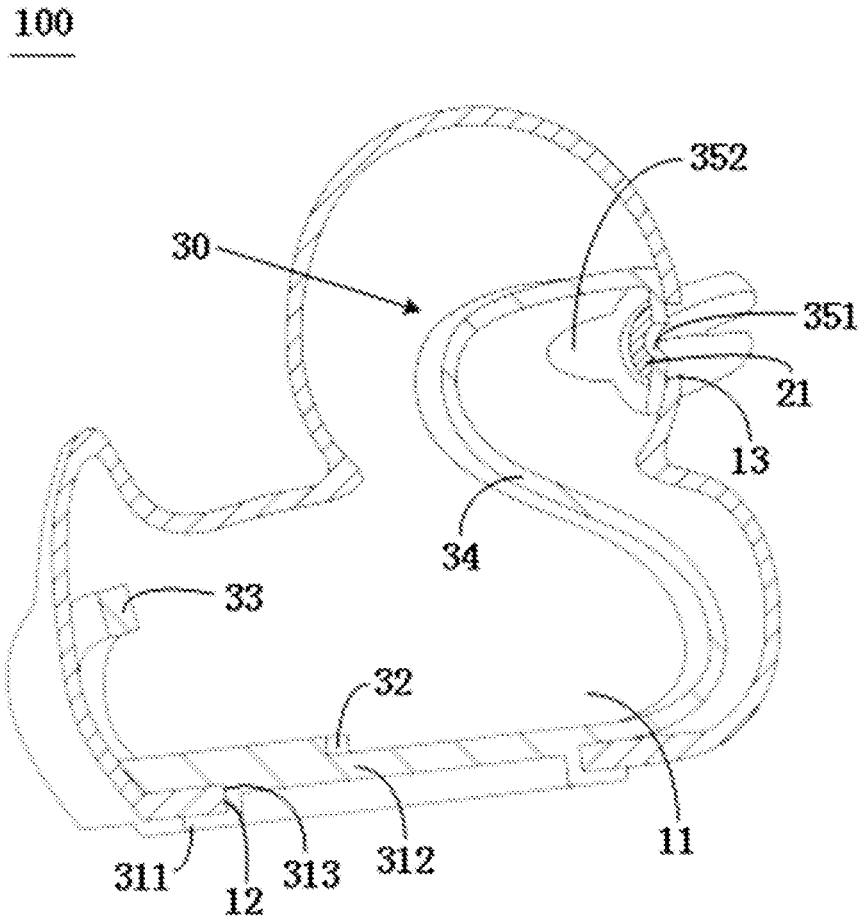
FIG. 3 is a cross-sectional view of the floatable toy shown in FIG. 1.

Referring to FIGS. 1 and 2, illustrated is a floatable toy 100, comprising a toy body 10, a second engaging portion 20 and a skeleton 30. Both the second engaging portion 20 and the skeleton 30 in a detachable assembly are assembled with the toy body 10 in a detachable manner, and are partially located in the toy body 10. The bottom of toy body 10 is opened or closed by the bottom of skeleton 30 working as a seal lid.

The floatable toy 100 as a bath toy is popular among children. In this embodiment, the floatable toy 100 is a duck. However, the floatable toy 100 is not limited to the duck, and it may be other animal toys or non-animal toy.

Specifically, the toy body 10 is made of lightweight plastics and is capable of floating on the water. Further, the toy body is made of soft plastics, such as rubbers or polyvinyl chloride that is deformable under compression due to material's flexibility and elasticity characteristic.

The toy body 10 is provided with a receiving cavity 11, a first opening 12 and a second opening 13. The first opening 12 and the second opening 13 both communicate with the receiving cavity 11 and an external window environment. The receiving cavity 11 is configured to partially accommodate the second engaging portion 20 and the skeleton 30. Specifically, the skeleton 30 is partially inserted into the receiving cavity 11 via the first opening 12, and the second engaging portion 20 is partially inserted into the receiving cavity 11 via the second opening 13.

A mushroom head rivet 21, which is mushroom-shaped with a tail connecting to the second engaging portion 20, and one end of the mushroom fastener head rivet 21 passes through the second opening 13 and is assembled with the skeleton 30, so that the toy body 10, the second engaging portion 20 and the skeleton 30 are connected. At the same time, the second opening 13 is blocked to prevent external water from entering the receiving cavity 11.

In some embodiments, the second engaging portion 20, the toy body 10 and the skeleton 30 are assembled together via other structures, such as but not limited to a mushroom head rivet 21.

As shown in FIGS. 1 & 2, the toy body 10 is opened or closed by the skeleton 30 which is configured to support the toy body 10 and block the first opening 12 and the second opening 13, so that the receiving cavity 11 is sealed to prevent the entrance of external water.

In this embodiment, the skeleton 30 is made of flexible plastics that is elastic and strong.

Specifically, the skeleton 30 comprises a first engaging portion 31, a reinforcing portion 32, a hanger ring 33, a first connecting portion 34 and a second connecting portion 35. The first engaging portion 31 is substantially circular, and the reinforcing portion 32, substantially semi-circular, is located on one side of the first engaging portion 31 that connects with the hanger ring 33 which is bent at a junction of the hanger ring and the first engaging portion. One end of the first connecting portion 34 is connected to the first engaging portion 31, and the other end of the first connecting portion is connected to the second connecting portion 35. The hanger ring 33 and the first connecting portion 35 are respectively located on two opposite sides of the first engaging portion 31.

In some embodiments, the first engaging portion 31 is in other shapes, which corresponds to the shape of the first opening 12.

The first engaging portion 31 comprises an outer engaging portion 311, an inner engaging portion 312 and a clamping groove 313. The inner engaging portion 312 extends from one side of the outer engaging portion 311 away from the outer engaging portion 311. In addition, a diameter of the outer engaging portion 311 is larger than that of the inner engaging portion 312. The clamping groove 313, arranged on the inner engaging portion 312, extends around the inner engaging portion 312, and is located between the outer engaging portion 311 and the inner engaging portion 312. Moreover, end surfaces of the clamping groove 313 and the outer engaging portion 311 are flush. The clamping groove 313 is configured to assemble with the toy body 10, so that the skeleton 30 is fixed and connected to the toy body 10 in a snap fit.

When installed, the first opening 12 and the clamping groove 313 are tightly assembled, and the outer engaging portion 311 is located outside the receiving cavity 11 to block the first opening 12.

In some embodiments, a recess (not shown) in a circular shape is further provided on the first engaging portion 31, and extends from a side of the outer engaging portion 311 away from the inner engaging portion 312 to the inner engaging portion 312.

The recess allows the clamping groove 313 and the first opening 12 to be easily press fitted by hand. At the same time, materials are saved. Of course, the recess is not indispensable.

The reinforcing portion 32 extends from a side of the inner engaging portion 312 away from the inner engaging portion 312. The reinforcing portion 32 and the inner engaging portion 312 have a same diameter. The outer engaging portion 311, the inner engaging portion 312 and the reinforcing portion 32 have the same center.

The reinforcing portion 32 is provided with a concave area (not shown), which is semi-circular and is located at a center of the inner engaging portion 312 with respect to the inner engaging portion 312. The concave area is embedded through the reinforcing portion 32, and a bottom of the concave area is flush with an end surface of the inner engaging portion 312 connected to the reinforcing portion 32.

The reinforcing portion 32 is configured to thicken and strengthen the first engaging portion, which increases the load-carrying capability of the skeleton 30, so that the skeleton 30 is hard to be damaged under external forces, thus prolonging the service life thereof. Moreover, the reinforcing portion 32 having certain weight itself is located on the inner engaging portion 312, which causes a larger weight when the reinforcing portion 32 and the first engaging portion 31 are stacked together, so that the skeleton is more stable in the toy body 10, and the toy itself is more balanced when floating on the water.

In some embodiments, when the first engaging portion 31 has a sufficient thickness, the reinforcing portion 32 may not be required. The hanger ring 33 is connected to the reinforcing portion 32 and the inner engaging portion 312, and is bent at a junction of the reinforcing portion and the hanger ring and a junction of the inner engaging portion and the hanger ring. A through hole 331, substantially semi-circular, is provided on the hanger ring 33.

The hanger ring 33 is configured to support and stabilize the skeleton 30. When the first engaging portion 31 is detached from the the toy body 10, the hanger ring 33 can serve to hang on other objects for drying purpose.

In some embodiments, the hanger ring 33 is not equipped on the first engaging portion 31.

The first connecting portion 34 is S-shaped, and one end of the first connecting portion is connected to the inner engaging portion 312, and the other end of the first connecting portion is connected to the second connecting portion 35. The first connecting portion 34 and the hanger ring 33 are respectively located at two opposite sides of the inner engaging portion 312.

After installed, the first connecting portion 34 applies a an oppositional force to the second connecting portion 35 into position, so the second connecting portion 35 abuts and locks against an inner wall of the receiving cavity 11, thereby blocking the gap between the second engaging portion 20 and the second opening 13 to prevent water entering the receiving cavity, and supporting and stabilizing the skeleton 30.

The second connecting portion 35 is bent at a junction of the first connecting portion 34 and the second connecting portion 35. A mounting hole 351 is provided on and penetrates through the second connecting portion 35, and is configured to assemble with the toy body 10. A blocking portions 352 composed of two parts is arranged on the second connecting portion 35 along a radial direction of the second connecting portion. The two parts are located outside the second connecting portion 35 and connected to the second connecting portion 35. Moreover, the two parts are symmetrical with respect to the first connecting portion 34. The second connecting portion 35 and the two parts 352 are all curved toward the first connecting portion 34.

In this embodiment, the second connecting portion 35 is used to assemble with the second engaging portion 20, and the mushroom head rivet 21 of the second engaging portion 20 passes through the second opening 13 and tightly assembles with the mounting hole 351, preventing the external water from entering the receiving cavity 11 through the gap between the mushroom head rivet 21 and the mounting hole 351. The first connecting portion 34 applies an oppositional force on the second connecting portion 35, so that the second connecting portion 35 and the blocking portion 352 abut against the inner wall of the receiving cavity 11, thereby blocking the second opening 13 to prevent the external water from entering the receiving cavity 11 via the second opening 13.

In some embodiments, the second connecting portion 35 is not bent at a junction.

A mounting method of this embodiment is described as follows. One end of the second connecting portion 35 of the skeleton 30 is inserted into the receiving cavity 11 of the toy body 10, and one end of the second engaging portion 20 passes through the second opening 13 and fixes with the mounting hole 351 of the second connecting portion 35. Finally, the first opening 12 of the toy body 10 and the clamping groove 313 of the skeleton 30 are engaged in a snap fit.

It should be noted that, in this embodiment, the toy body 10 and the skeleton 30 are both made of plastics, and further, the toy body 10 is made of soft plastics that can be deformed by squeeze due to flexibility thereof, thus, the above mounting method can be implemented.

In the technical solution of the present application, the floatable toy 100 comprises a toy body 10 and a skeleton 30. The toy body 10 comprises a receiving cavity 11 and a first opening 12, and the skeleton 30 comprises a first engaging portion 31 comprising an outer engaging portion 311, an inner engaging portion 312 and a clamping groove 313. The clamping groove 313 is arranged on the inner engaging portion 312 and extends around the inner engaging portion 312. The toy body 10 is closely engaged with the clamping groove 313 via the first opening 12, thereby realizing a detachable assembly of the toy body 10 and the skeleton 30, so that the first opening 12 is blocked. When the interior of the floatable toy 100 needs to be cleaned, the skeleton 30 can be removed to ensure the cleanliness of the floatable toy 100.

Further, the toy body 10 further comprises a second opening 13, and the floatable toy 100 further comprises a second engaging portion 20 which is provided with a mushroom head rivet 21. A first connecting portion 34 and a second connecting portion 35 are provided on the skeleton 30. One end of the first connecting portion 34 is connected to the first engaging portion 31, and the other end of the second connecting portion is connected to the second connecting portion 35, so that the first engaging portion 31 and the second connecting portion 35 are connected. A mounting hole 351 is provided on the second connecting portion 35, is configured to assemble with the mushroom head rivet 21. The mushroom head rivet 21 of the second engaging portion 20 passes through the second opening 13 and the mounting hole 351 to tightly assemble with the mounting hole 351, thereby connecting the second engaging portion 20, the toy body 10 and the skeleton 30, blocking the gap between the mushroom head rivet 21 and the mounting holes 351. A blocking portion 352 composed two parts is further provided on both sides of the second connecting portion 35. The first connecting portion 34 can not only connect the first engaging portion 31 and the second connecting portion 35, but also it applies a force on the second connecting portion 35, so that the second connecting portion 35 and the blocking portion 352 abut against the inner wall of the receiving cavity 11, thereby blocking the gap between the second opening 13 and the mushroom head rivet 21 to prevent external water from entering the receiving cavity 11.

Further, through the above-mentioned mounting method, one end of the skeleton 30 assembles with the toy body 10, and the other end of the skeleton assembles with the second engaging portion 20. Since the child, especially the infant, can exert a small strength, the skeleton is hard to be separated with the toy body 10 and the second engaging 20, thus avoiding the dangers that the second engaging portion is swallowed by children who are not cared after the floatable toy 100 is dismantled.

Example 2

Figure 4:
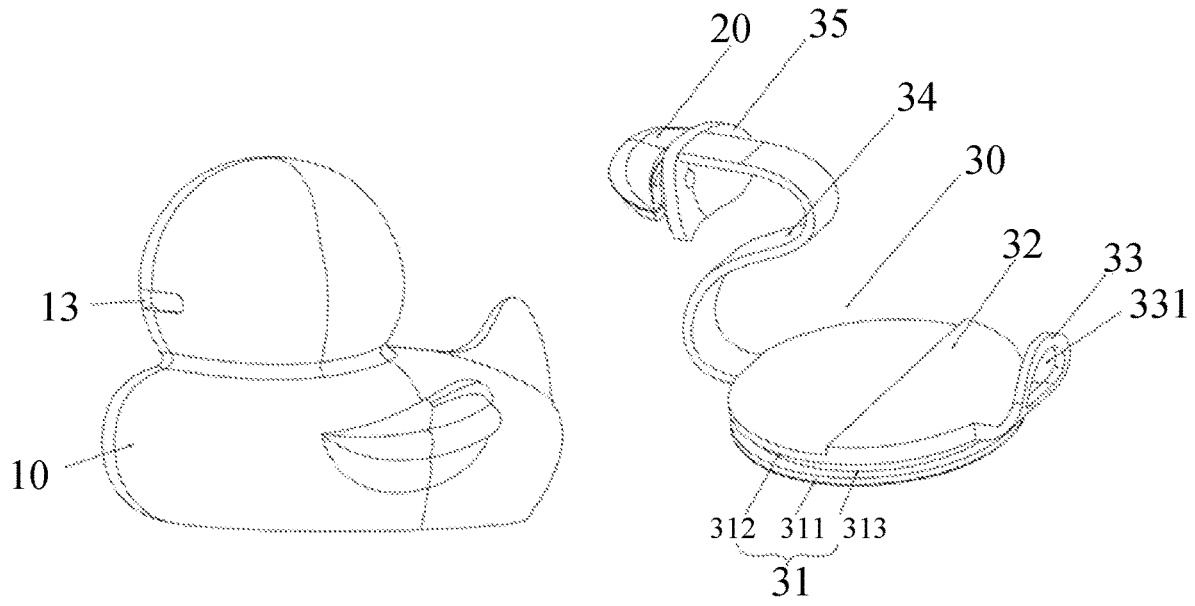
FIG. 4 is an exploded view of the floatable toy according to a second embodiment of the present invention.

As shown in FIG. 4, illustrated is a second embodiment of the present invention. The differences between this embodiment and Example 1 are as follows. In this embodiment, the mushroom head rivet 21 is removed from the second engaging portion 20, and the skeleton 30 and the second engaging portion 20 are in a one-piece structure, which is different from Example 1 in which the second engaging portion 20 is detachably assembled with the skeleton 30. The second opening 13 of the toy body 10 is also changed correspondingly, where the circular through hole on the second opening 13 through which the mushroom clasp 21 passes is eliminated, and the second opening 13 is an elongated waist-shaped opening through which the second engaging portion 20 passes, and is stuck between the second engaging portion 20 and the second connecting portion 35. This embodiment is similar to Example 1, and the description for same structures are not repeated herein.

Example 3

Figure 5:
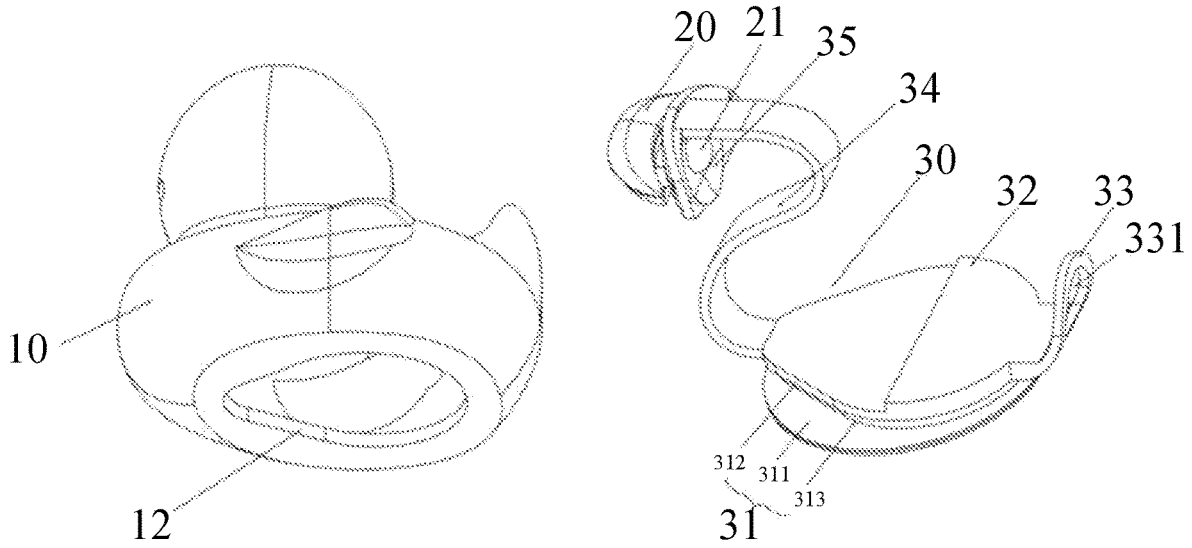
FIG. 5 is an exploded view of the floatable toy according to a third embodiment of the present invention.

As shown in FIG. 5, illustrated is a third embodiment of the present invention. The difference between this embodiment and Example 1 is the inner engaging portion 312. Further, the inner engaging portion 312 of this embodiment is different in shape than Example 1. In this embodiment, the inner engaging portion 312 is generally drop-shaped, and the size thereof is smaller than that of the outer engaging portion 311 and is larger than that of the clamping groove 313. The first opening 12 of the toy body 10 is correspondingly changed. The shape of the first opening 12 matches that of the inner engaging portion 312, and the first opening 12 passes the inner engaging portion 312, then is clamped in the clamping groove 313 located between the inner engaging portion 312 and the outer engaging portion 311. This embodiment is similar to Example 1, and the description for the same structures are omitted.

Example 4

Figure 6:
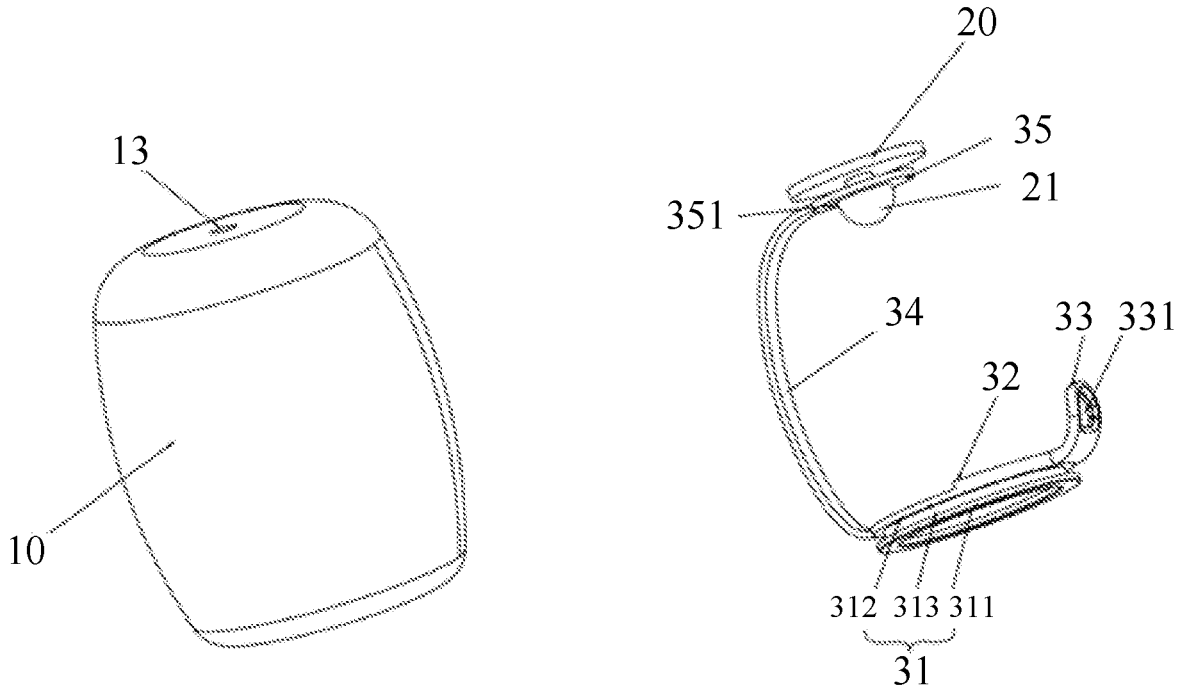
FIG. 6 is an exploded view of the floatable toy according to a fourth embodiment of the present invention.

As shown in FIG. 6, illustrated is a fourth embodiment of the present invention. The differences between this embodiment and Example 1 are as follows. In this embodiment, the toy body 10 is cylindrical, and a second opening 13 is a circular through hole which is arranged at the middle of the top of the toy body 10. The first connecting portion 34 of the skeleton 30 is C-shaped. The second engaging portion 20 is circular and is detachably connected to the skeleton 30. This embodiment is similar to Example 1, and the description for same structures are not repeated herein.

Example 5

Figure 7:
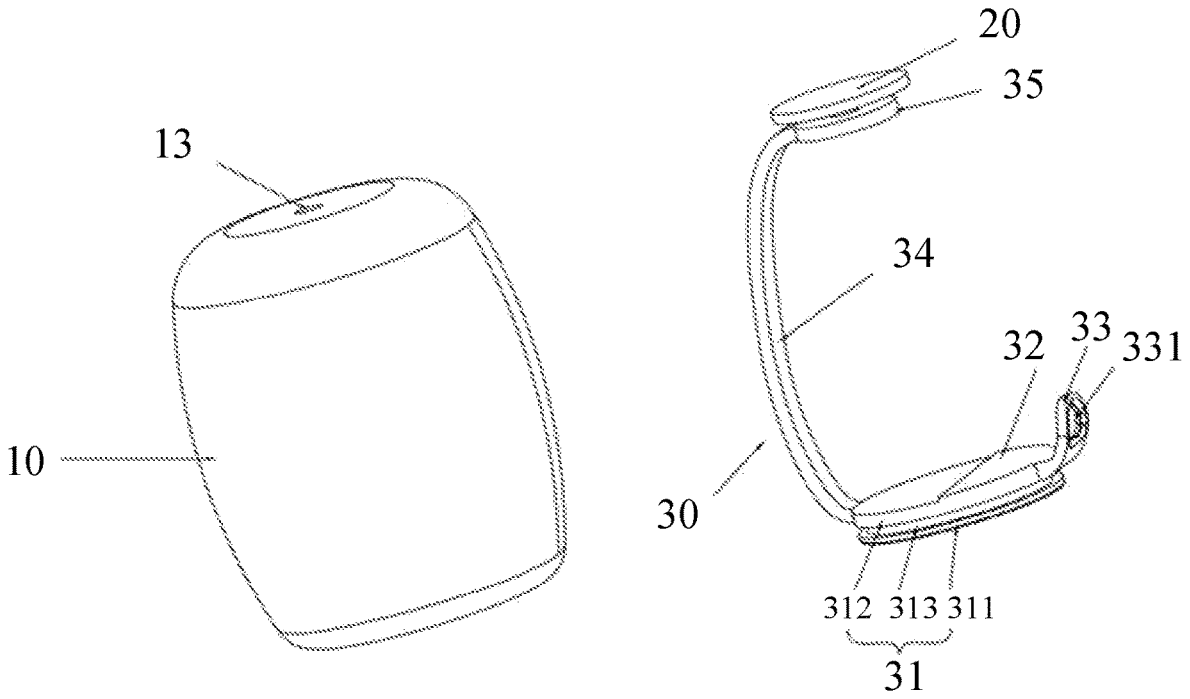
FIG. 7 is an exploded view of the floatable toy according to a fifth embodiment of the present invention.

As shown in FIG. 7, illustrated is a fifth embodiment. The differences between this embodiment and Example 4 are as follows. In this embodiment, the mushroom head rivet 20 is removed from the second engaging portion, and the skeleton 30 and the second engaging portion 20 are in a one-piece structure which is different from Example 4 in which the second engaging portion 20 is detachably assembled with the skeleton 30. This embodiment is similar to Example 4, and the description for same structures are not repeated herein.

Example 6

A sixth embodiment is illustrated. This embodiment is similar to Example 1, except for the skeleton 30, and the description for same structures are not repeated herein.

Figure 8:
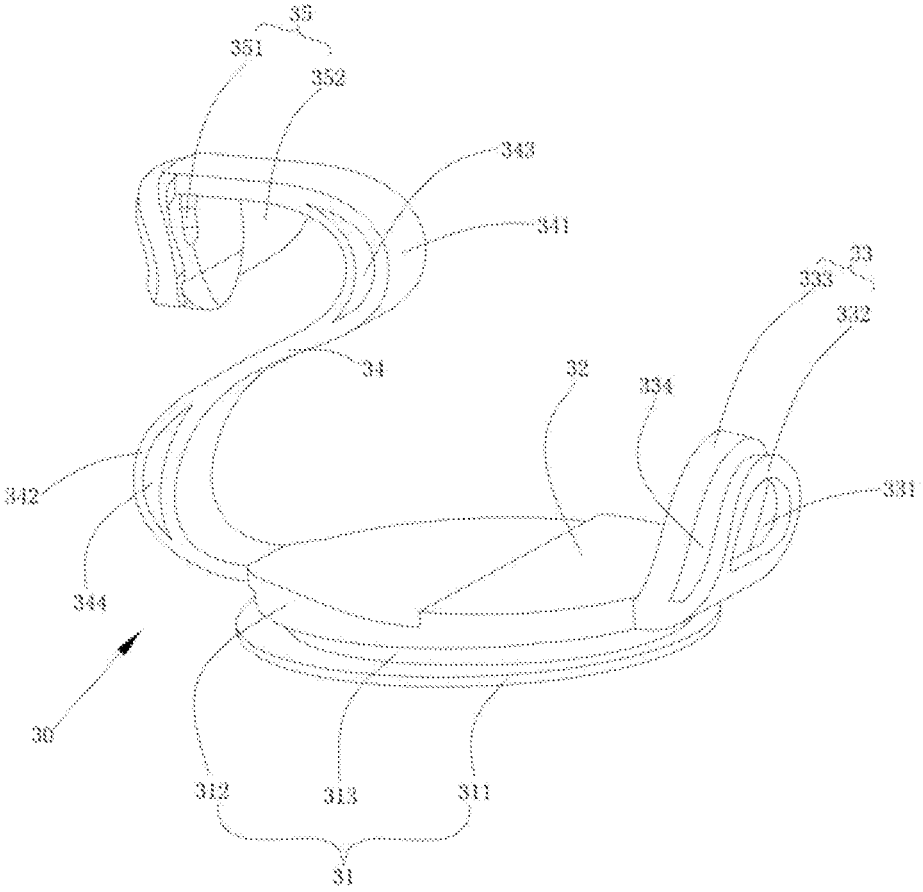
FIG. 8 is a perspective view showing a skeleton according to a sixth embodiment of the present invention.

Specifically, as shown in FIG. 8, the first connecting portion 34 in this embodiment is different from that in Example 1. Further, in this embodiment, a first bending portion 341 is close to the second connecting portion 35, and a second bending portion 342 is close to the inner engaging portion 312. A first cavity 343 is provided at the first bending portion 341 of the first connecting portion 34, and a second cavity 344 is provided at the second bending portion 342 of the first connecting portion 34, and the first cavity 343 and the second cavity 344 both penetrate the first connecting portion 34. The first cavity 343 is arranged along a radial direction of the first bending portion 341, and the second cavity 344 is arranged along a radial direction of the second bending portion 342. The first cavity 343 and the second cavity 344 are both crescent-shaped and configured to improve the support strength and the service life of the first connecting portion 34, so that the first bending portion 341 or the second bending portion 342 are not broken due to compression and bending, thereby improving the supportability and stability of the skeleton 30.

A hanger ring 33 in this embodiment is different from that in Example 1. The hanger ring 33 further comprises a first hanger ring 332 and a second hanger ring 333, in which the first hanger ring 331 is provided with a through hole which has the same function as that in Example 1. The first hanger ring 332 abuts against the inner wall of the receiving cavity 11. The second hanger ring 333 which is a solid structure is provided on a side close to the reinforcing portion 32, and is integrally formed with the first hanger ring 332. A through groove 334 is arranged between the first hanger ring 332 and the second hanger ring 333. The second hanger ring 333 is configured to abut the first hanger ring 332 when the first hanger ring 332 is forced to be bent toward the second hanger ring 333, so that the support strength of the hanger ring 33 is increased, avoiding the reduced support strength of the first hanger ring 332 when the through hole 331 on the first hanger ring 332 becomes large in diameter. After the second hanger ring 333 is additionally provided, the size of the through hole 331 on the first hanger ring 332 will not affect the support strength of the hanger ring 33, so that the skeleton 30 is more stable.

The preferred embodiments are provided in the description and the drawings. However, it should be noted that the present invention can be implemented in many different forms, and is not limited to the embodiments. These embodiments are not intended to limit the scope of the present invention but to allow for full understandings of the present invention. Besides, various technical features described above may be further combined with each other to form various embodiments that are not listed herein, and these embodiments are considered to be within the scope of the present invention. Further, all improvements and modifications, made by those skilled in the art based on the above description shall fall within the scope of the appended claims.

What is claimed is:

1. A floatable toy, comprising:

a toy body provided with a receiving cavity and a first opening, and a skeleton provided with a first engaging portion;

wherein the skeleton is detachably assembled with the toy body; the first opening communicates with the receiving cavity and an external environment; and a clamping groove is provided on the first engaging portion, the clamping groove and the first opening are assembled to fixedly connect the toy body and the skeleton in a snap fit, thereby sealing the receiving cavity;

the floatable toy further comprises a second engaging portion which is provided with a mushroom head rivet and a second opening arranged on the toy body at a position corresponding to the second engaging portion;

wherein the skeleton further comprises a hanger ring serving to hang on objects when the first engaging portion is detached from the toy body;

a first connecting portion located in the receiving cavity, one end of the first connecting portion is connected to the first engaging portion; and a second connecting portion located in the receiving cavity;

wherein the second connecting portion is provided with a mounting hole; one end of the second engaging portion passes through the second opening and tightly fits with the mounting hole; the other end of the second connecting portion is connected to the other end of the first connecting portion.

2. The floatable toy of claim 1, wherein the first engaging portion comprises an outer engaging portion and an inner engaging portion; and the outer engaging portion and the inner engaging portion are both circular, and the inner engaging portion extends from a side of the outer engaging portion; the clamping groove extends around the inner engaging portion.

3. The floatable toy of claim 2, wherein the clamping groove and the first opening are assembled, and the outer engaging portion is located outside the receiving cavity.

4. The floatable toy of claim 2, wherein the skeleton further comprises a reinforcing portion for increasing a load-carrying capability of the skeleton;

the reinforcing portion is semi-circle shaped and has a same diameter with the inner engaging portion; and the semi-circle shaped reinforcing portion has the same center with the outer engaging portion and the inner engaging portion the reinforcing portion extends from a side of the inner engaging portion away from the inner engaging portion.

5. The floatable toy of claim 4, wherein the hanger ring is connected to the reinforcing portion or the inner engaging portion and is bent at a junction of the hanger ring and the reinforcing portion or a junction of the hanger ring and the inner engaging portion; and a through hole is provided on the hanger ring.

6. The floatable toy of claim 5, wherein one end of the first connecting portion is connected to the inner engaging portion.

7. The floatable toy of claim 6, wherein the second connecting portion is bent at a junction of the first connecting portion and the second connecting portion.

8. The floatable toy of claim 7, wherein the mounting hole is a through hole.

9. The floatable toy of claim 7, wherein the first connecting portion is S-shaped; the first connecting portion applies an oppositional force to the second connecting portion such that the second connecting portion abuts and locks against an inner wall of the receiving cavity.

10. The floatable toy of claim 1, wherein the toy body and the skeleton are both made of plastics; and the toy body is made of flexible and stretchable plastics.

* * * * *